US007523835B2

(12) United States Patent
Andersson

(10) Patent No.: US 7,523,835 B2
(45) Date of Patent: Apr. 28, 2009

(54) HYDRAULIC CRANE

(75) Inventor: Lars Andersson, Forsa (SE)

(73) Assignee: Hiab AB, Hudiksvall (SE)

( * ) Notice: Subject to any disclaimer, the term of this patent is extended or adjusted under 35 U.S.C. 154(b) by 583 days.

(21) Appl. No.: 11/156,690

(22) Filed: Jun. 20, 2005

(65) Prior Publication Data

US 2006/0045661 A1 Mar. 2, 2006

(30) Foreign Application Priority Data

Jun. 18, 2004 (EP) ..... 04014344

(51) Int. Cl.
*B66C 13/12* (2006.01)

(52) U.S. Cl. ..... 212/286; 212/289

(58) Field of Classification Search ..... 212/278, 212/286, 288, 289
See application file for complete search history.

(56) References Cited

U.S. PATENT DOCUMENTS 5,176,504 A * 1/1993 Moriya et al. ..... 417/216
5,359,516 A * 10/1994 Anderson ..... 701/50
5,701,691 A * 12/1997 Watanabe et al. ..... 37/348
6,048,177 A * 4/2000 Erkkilae et al. ..... 417/222.1
7,076,947 B2 * 7/2006 Ariga et al. ..... 60/452

FOREIGN PATENT DOCUMENTS

EP 0708053 4/1996
EP 1151958 11/2001

* cited by examiner

*Primary Examiner*—Thomas J. Brahan
(74) *Attorney, Agent, or Firm*—Dilworth & Barrese LLP

(57) ABSTRACT

The invention relates to a method for determining a present value of the capacity level of a hydraulic crane (1) provided with a lifting cylinder (8), the present value of the capacity level being determined by means of a processing unit (33). The initiation of each new lifting cycle of the crane is detected and a minimum value of each lifting cycle is registered, which represents the lowest hydraulic pressure on the piston side (8*a*) of the lifting cylinder during the lifting cycle or the lowest cylinder force of the lifting cylinder during the lifting cycle. For at least some of the lifting cycles, the processing unit (33) determines the present value of the capacity level of the crane taking into account a control value ($V_c$) corresponding to:

the minimum value registered for the previous lifting cycle, or the lowest one of the minimum value registered for the previous lifting cycle and the minimum value registered for the present lifting cycle.

The invention also relates to a hydraulic crane (1) comprising means for implementing the inventive method.

20 Claims, 3 Drawing Sheets

HYDRAULIC CRANE

BACKGROUND OF THE INVENTION

Field of the Invention and Prior Art

The present invention relates to a hydraulic crane, preferably a lorry crane, and a method for regulation of the capacity level of such a crane.

In this description, the term "capacity level" is used as an expression for the maximum allowed lifting force of a hydraulic crane.

Hydraulic lorry cranes are used for many different types of working operations, such as:

A) lifting of load between a lorry platform and ground, i.e. for unloading a load from a lorry platform or loading a load onto a lorry platform, B) assembly work, comprising for instance lifting and positioning of a transformer and keeping it in place until it has been fixed on the intended place, C) lifting using a jib, e.g. for lifting a load onto the roof of a building at a building site, D) minor excavation and construction work with a hydraulically operated bucket, E) handling of scrap by means of a hydraulic grab tool, F) lifting of building material, such as bricks or building plates arranged on pallets or bundles of plasterboards, by means of a hydraulic grab tool, and G) lifting and emptying of recycling containers, i.e. containers for the collection of recyclable waste products, by means of a hydraulic grab tool.

In the lifting of load between a lorry platform and the ground, i.e. during working operations of the above-indicated type A, it is for instance used a hook together with lifting strings or some simple type of mechanical lifting tool, such as a pallet fork. In this type of working operation, a rotator may be arranged between the crane boom and the hook. The stressing on the crane can in this case normally be characterized as low to moderate.

In working operations of the above-indicated type B, a hook and lifting strings are normally used. It also occurs that a winch is used in combination with hook and lifting strings, particularly if the load is to be lowered down into a narrow hole or the similar. This type of working operation normally implies a low stressing on the crane, since the crane is standing still and holds a static load during the major part of the work.

For large lifting heights a so-called jib is used to make possible a longer reach and a more exact positioning of the load. When a jib is used, i.e. during working operations of the above-indicated type C, the crane will generally be subjected to higher stresses than during working operations of the above-indicated types A and B due to the long range and the load swings which are increasing with the range. Furthermore, the lifting frequency might be high when a jib is used, which results in high stressing on the crane.

Minor excavation and construction works with a hydraulic grab tool in the form of a hydraulically operated bucket, i.e. working operations of the above-indicated type D, often result in very high stressing on the crane. Partly due to the high working intensity in the working operations and partly due to the fact that the crane besides being used for lifting excavation masses by means of the bucket also is used for pressing the bucket down into the ground, which results in higher stresses per lifting cycle than during simple lifting operations. The bucket is normally fastened to a rotator which makes possible a rotation of the bucket.

Working operations of the above-indicated type E, involving lifting and dropping of scrap such as metal scrap, often result in very high stressing on the crane. Partly due to the fact that the working during this type of working operations normally is very intense, and partly due to the fact that the crane, as during excavation and construction work, sometimes is used for exerting a pressing force in order to press down scrap. Very high stresses on the crane will also be induced by sudden droppings of heavy loads of scrap due to the recoil of the crane in connection with a sudden release of a hanging heavy load. A hydraulic grab tool particularly designed for scrap handling will in the following be denominated "scrap tool".

Working operations of the above-indicated type F, involving lifting and lowering of pallets or bundles of building material, normally imply a moderate stressing on the crane. A hydraulic grab tool particularly designed for handling building material in the form of bricks or blocks arranged on pallets will in the following be denominated "brick and block clamp". A hydraulic grab tool particularly designed for handling bundles of plasterboards will in the following be denominated "dry wall clamp".

Working operations of the above-indicated type G normally imply a moderate stressing on the crane. A hydraulic grab tool particularly designed for handling recycling containers will in the following be denominated "recycling accessory".

Previously, lorry cranes were normally given one and the same capacity level, i.e. one and the same maximum allowed lifting force, for all types of working operations, and were therefore fatigue dimensioned for the hardest type of working. This implied that smaller and middle-sized cranes (3-20 ton meters) normally were dimensioned for working operations of type D, whereas larger cranes (>20 ton meters) normally were dimensioned for assembly work or jib working, i.e. working operations of type B or C. A dimensioning for the hardest type of working will result in a non-optimal use of the crane material during all types of lighter working, since the crane during the performance of working operations implying lighter working will be unnecessary expensive and heavy in relation to the capacity level required for these working operations. It should also be mentioned that one and the same crane often is used for several different types of working operations. In the extreme case one and the same crane can be used for all the above mentioned types of working operations.

The different types of working operations cause different damaging stress per lifting cycle on the welded steel structure of the crane. According to more resent steel structure standards for the dimensioning of cranes (e.g. EN13001) the damaging stress per lifting cycle depends on the difference between the highest and the lowest load during the respective lifting cycle, the so called stress range. This will for instance imply that an excavation cycle (working operation of type D), where the crane presses the bucket down into the ground with a force of 2 kN and thereafter lifts up the bucket filled with load with a lifting force of 10 kN, causes the same fatigue damage to the crane as a lifting cycle where a load is lifted in a hook (working operation of type A) with a lifting force of 12 kN. If the static strength so allows, it would in accordance with this example be possible to lift approximately 20% more load with one and the same crane during simple lifting as compared to excavation without jeopardizing the fatigue strength.

That particularly excavation work and scrap handling imply very high stressing on the crane is previously known, and different solutions to the above-mentioned dimensioning problem have been suggested during the years. In 1985 the applicant, HIAB AB, introduced the expression "hook working", which implied that the crane, if it was not equipped with a set of conduits and hoses for tool functions and only adapted to the four crane functions rotation, lifting, tilting and extension, was given a capacity level that was 5-10% higher than if it had been provided with such a set of conduits and hoses, since the crane without such a set of conduits and hoses only could be used for working operations of type A and B. If the crane was equipped with a set of conduits and hoses for tool functions it was always given the lower so-called tool capacity adapted to working operations of type D and E. This irrespective of whether or not the crane temporarily was used for lighter working involving working operations of type A and B. The capacity level was completely determined by the design the crane was given during the assembly thereof and no good optimisation was obtained.

A more recent solution for allowing different values of the capacity level for different types of working operations is disclosed in the applicant's Swedish patent SE 520 536 C2. According to this solution, the crane comprises means for the registration of which crane functions that are being controlled via the control system of the crane, and a processing unit adapted to identify, based on these registrations, the performed working operation as being of a certain type among a number of predetermined types of working operations. The processing unit is further adapted to determine a present value of the capacity level of the crane in dependence on the identified type of working operation. A limitation with this solution is that no difference is made between different types of tool working involving the control of a hydraulic grab tool, i.e. between working operations of type D-G. This is due to the fact that the different grab tools used for performing working operations of type D-G normally all are controlled by means of one and the same control button or control lever.

OBJECT OF THE INVENTION

The object of the present invention is to accomplish an improved method for determining a present value of the capacity level of a hydraulic crane.

SUMMARY OF THE INVENTION

According to the present invention, this object is achieved by a method having the features described herein.

The invention is based on the realisation that the lowest value, here denominated "minimum value", during a lifting cycle of the hydraulic pressure on the piston side of the lifting cylinder or the cylinder force of the lifting cylinder is a factor that affects the magnitude of the stress on the crane during the lifting cycle. The lower the minimum value during a lifting cycle, the higher the stress exerted on the crane for a specific upper value of the load on the crane during the lifting cycle. This is due to the fact that the stress range during a lifting cycle will increase when the lowest value during the lifting cycle of the load on the crane decreases for a given upper value of the load on the crane during the lifting cycle. According to the invention, the processing unit should for at least some of the lifting cycles determine the present value of the capacity level of the crane, i.e. the present value of the maximum allowed lifting force of the crane, taking into account a control value corresponding to:

- the minimum value registered for the previous lifting cycle, or
- the lowest one of the minimum value registered for the previous lifting cycle and the minimum value registered for the present lifting cycle.

The minimum value is intended to be taken into account by the processing unit in the determination of the capacity level of the crane at least for lifting cycles involving the operation of a hydraulic grab tool, i.e. working operations of type D-G, so as to allow different values of the capacity level to be set depending on the stress range caused by the actual operation of the grab tool.

A crane is normally operated repeatedly in essentially the same manner during a working period and the minimum value registered for the previous lifting cycle can therefore be used as a rough estimation of the minimum value for a presently performed lifting cycle. If a higher accuracy is desired, the lowest one of the minimum value registered for the previous lifting cycle and the minimum value registered for the present lifting cycle may be used as the above-indicated control value.

In this description the expression "previous lifting cycle" refers to the lifting cycle performed immediately before a presently performed lifting cycle, i.e., the immediately preceding lifting cycle.

According to a first alternative, the present value of the capacity level of the crane is calculated by a formula having the control value as a variable parameter. In this case, the minimum value directly affects the determination of the present value of the capacity level for the lifting cycles associated with all types of working operations performed with the crane.

According to a second alternative, the processing unit identifies, based on registrations of the crane functions that are being controlled, the working operation performed during the respective lifting cycle as being of a certain type among a number of predetermined types of working operations, wherein:

- the processing unit takes the identified type of working operation into account in the determination of the present value of the capacity level of the crane by selecting, among a number of stored preset values representing the capacity level of the crane for the predetermined types of working operations, the values applying for a type of working operation corresponding to the identified one, and
- the processing unit for each lifting cycle where the performed working operation is identified as a working operation involving the operation of a hydraulic grab tool attached to the crane also takes the control value into account in the determination of the present value of the capacity level of the crane.

In this case, the minimum value affects the determination of the present value of the capacity level for the lifting cycles associated with working operations involving the operation of a hydraulic grab tool, i.e. working operations of type D-G. For lifting cycles associated with the other types of working operations, the present value of the capacity level may be determined in a manner corresponding to the manner indicated in SE 520 536 C2.

The invention also relates to a hydraulic crane having the features described herein.

Preferred embodiments of the invention will appear from the subsequent description.

BRIEF DESCRIPTION OF THE DRAWINGS

The invention will in the following be more closely described by means of embodiment examples, with reference to the appended drawings. It is shown in.

DETAILED DESCRIPTION OF PREFERRED EMBODIMENTS

In this description the expression "force member" is used to designate the hydraulic force members which execute the crane movements ordered by the operator of the crane. The expression force member consequently embraces the hydraulic cylinders 8, 9, 10, 14, 17 and 19 mentioned hereinafter. The expression "control member" refers to the members, for instance control levers or control buttons, by means of which the operator regulates the valve members that are included in the control system and control the flow of hydraulic fluid to the respective force member. In the described embodiment, said valve members consist of so-called directional-control-valve sections.

Figure 1:
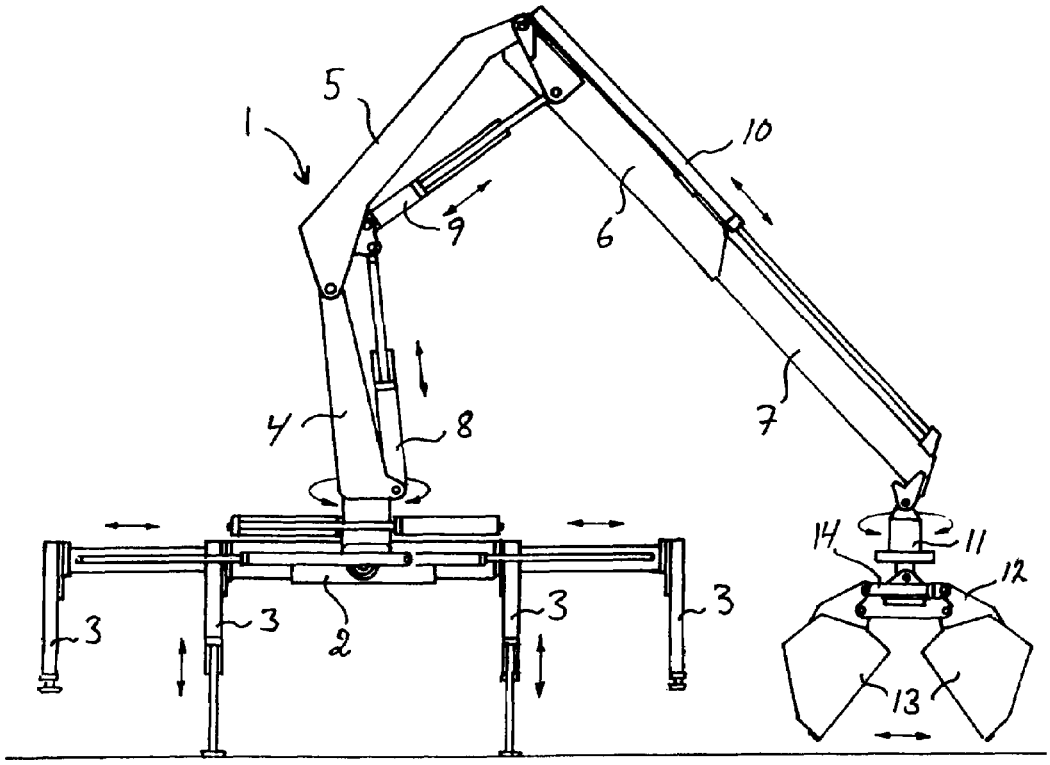
FIG. 1 a lateral view of a hydraulic crane equipped with a bucket.

In FIG. 1 a hydraulic crane 1 attached to a frame 2 is shown, which frame for instance can be connected to a lorry chassis. The frame is provided with adjustable support legs 3 for supporting the crane 1. The crane comprises a column 4, which is rotatable in relation to the frame 2 around an essentially vertical axis. The crane further comprises an inner boom 5 articulately attached to the column 4, an outer boom 6 articulately attached to the inner boom 5 and an extension boom 7 displaceable attached to the outer boom 6. The inner boom 5 is operated by means of a hydraulic lifting cylinder 8, the outer boom 6 by means of a hydraulic outer boom cylinder 9 and the extension boom 7 by means of a hydraulic extension boom cylinder 10. In the shown example, a rotator 11 is articulately attached at the outer end of the extension boom 7, which rotator in its turn carries a hydraulic grab tool in the form of a bucket 12. Two bucket parts 13 included in the bucket 12 are pivotable in relation to each other by means of a hydraulic grab cylinder 14 for opening and closing of the bucket 12. The rotator 11 is rotatable in relation to the extension boom 7 by means of a hydraulic force member.

In the example shown in FIG. 1, the crane 1 is equipped for performing excavations, i.e. working operations of the above-indicated type D. When the crane 1 is to be used for working operations of type A, i.e. for proper lifting operations, the rotator 11 and the bucket 12 may be removed and replaced by a lifting hook. It is also possible to keep the rotator 11 and replace the bucket 12 by a lifting hook. In order to perform lifting operations of the above-indicated type C, the rotator 11 and the bucket 12 are replaced by a jib 15, see FIG. 2. The jib 15 comprises a jib boom 16, which is articulately attached in relation to the extension boom 7 and operated by means of a hydraulic jib boom cylinder 17. The jib may further comprise an extension boom 18, which is operated by means of a hydraulic extension boom cylinder 19.

Figure 2:
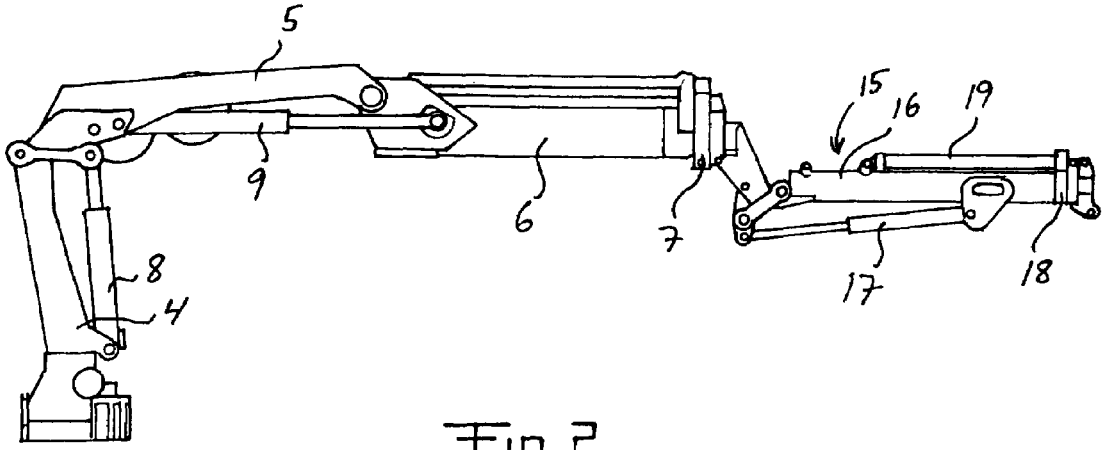
FIG. 2 a lateral view of a hydraulic crane equipped with a jib.

In addition to the crane elements shown in FIGS. 1 and 2, the crane 1 may also be equipped with a hydraulically controllable winch, which can be used in combination with a lifting hook either with or without jib 15. The crane 1 may also be equipped with other types of hydraulic grab tools than a bucket, such as a scrap tool, a brick and block clamp, a dry wall clamp or a recycling accessory.

The control system for controlling the different crane functions, i.e. lifting/lowering by means of the lifting cylinder 8, tilting by means of the outer boom cylinder 9, extension/retraction by means of the extension boom cylinder 10 etc, comprises a pump 20 which pumps hydraulic fluid from a reservoir 21 to a directional-control-valve block 22. The directional-control-valve block 22 comprises a directional-control-valve section 23 for each of the hydraulic force members 8, 9, 10, 14, 17, 19, to which hydraulic fluid is supplied in a conventional manner depending on the position of the slide member in the respective valve section 23. The position of the slide members in the directional-control-valve sections 23 is controlled via a number of control members, for instance in the form of control levers 24, each of which being connected to its own slide member, or by remote control via a control unit 25 (see FIG. 4) comprising a control lever or button for the respective slide member. In case of remote control, the control signals are transmitted via cable or a wireless connection from the control unit 25 to a microprocessor, which in its turn controls the position of the slide members in the valve sections 23 of the directional-control-valve block 22 depending on the magnitude of the respective control signal from the control unit 25.

Figure 3:
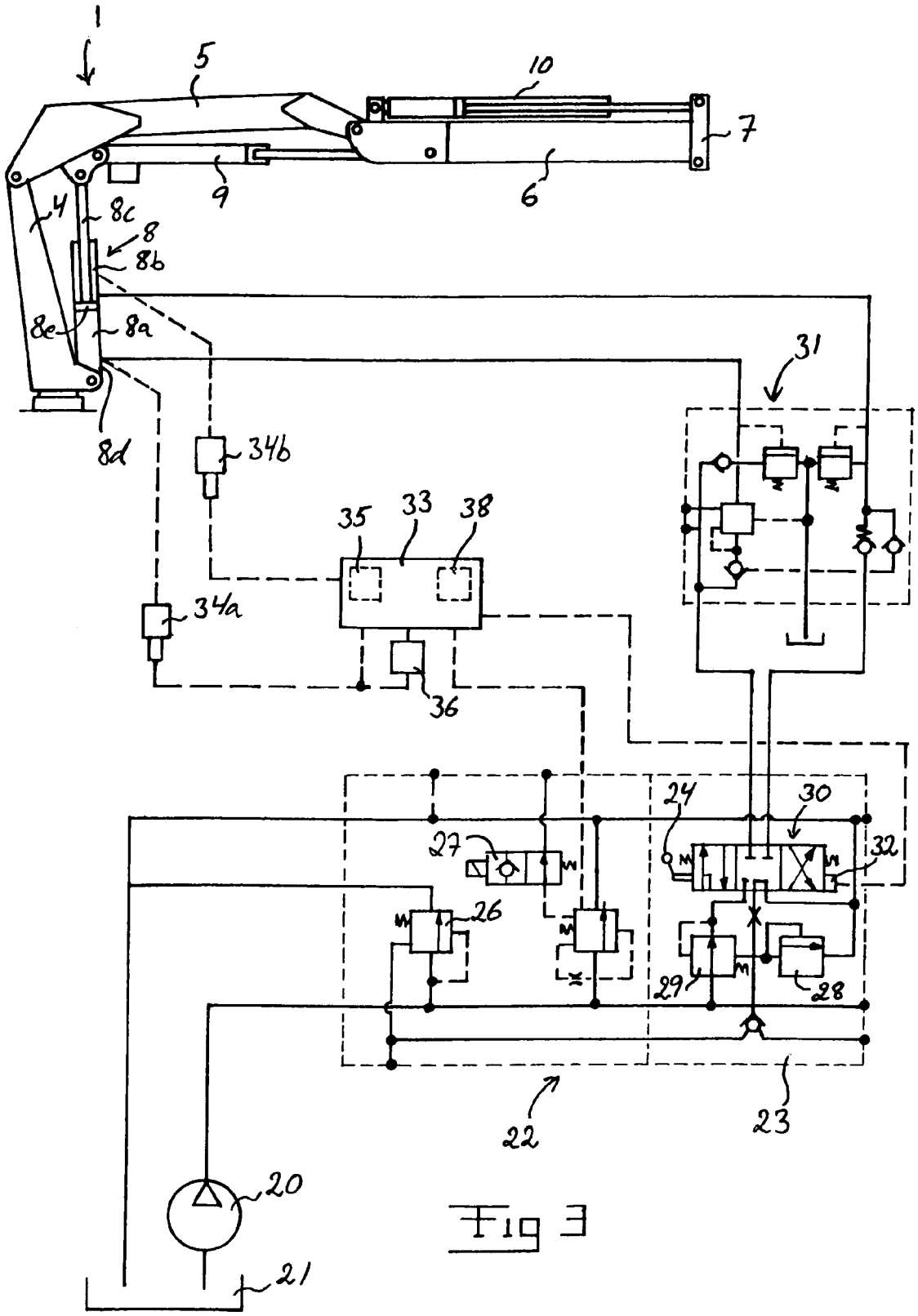
FIG. 3 a schematical illustration of an embodiment of the invention.

Each separate directional-control-valve section 23 consequently controls the size and the direction of the flow of hydraulic fluid to a specific force member and thereby controls a specific crane function. For the sake of clarity, only the directional-control-valve section 23 for the lifting cylinder 8 is illustrated in FIG. 3.

The directional-control-valve block 22 further comprises a bypass valve 26 pumping excessive hydraulic fluid back to the reservoir 21, and an electrically controlled dump valve 27 which can be caused to return the entire hydraulic flow from the pump directly to the reservoir 21.

In the shown embodiment, the directional-control-valve block 22 is of load-sensing and pressure-compensating type, which implies that the hydraulic flow supplied to a force member is at all times proportional to the position of the slide member in the corresponding directional-control-valve section 23, i.e. proportional to the position of the lever 24. The directional-control-valve section 23 comprises a pressure-limiting device 28, a pressure-compensating device 29 and a directional-control-valve 30. Directional-control-valve blocks and directional-control-valve sections of this type are well-known and available on the market.

However, also other types of directional-control-valves than the one described here can be used.

A load holding valve 31 is arranged between the respective force member and the associated directional-control-valve section 23, which load holding valve makes sure that the load will remain hanging when the hydraulic system runs out of pressure as the dump valve 27 is caused to return the entire hydraulic flow from the pump 20 directly to the reservoir 21.

A sensor 32 is arranged in each of the directional-control-valve sections 23 in order to detect the movements of the valve slide member in the respective directional-control-valve section 23. These sensors 32 are connected to a processing unit 33 suitably constituted by a microprocessor. By means of these sensors 32, the processing unit 33 can obtain information that a certain valve slide member is influenced and thereby that a certain crane function is controlled via the control system of the crane. In case the valve slide members are regulated via a remote control unit 25, the processing unit 33 can instead be adapted to obtain information about which crane functions that are being controlled by reading the control signals transmitted from the control unit 25.

The crane further comprises a first pressure sensors 34*a* adapted to measure the hydraulic pressure on the piston side 8*a* of the lifting cylinder 8 and a second pressure sensor 34*b* adapted to measure the hydraulic pressure on the rod side 8*b* of the lifting cylinder. These pressure sensors 34*a*, 34*b* are connected to the processing unit 33.

The crane 1 further comprises detecting means 36 for detecting the initiation of a new lifting cycle of the crane by detecting when the crane lifts up a load. The detecting means 36 detects this by detecting the velocity of the pressure increase on the piston side 8*a* of the lifting cylinder 8, which pressure increase is measured by the pressure sensor 34*a*. During lifting up of a load, the pressure on the piston side 8*a* of the lifting cylinder 8 very rapidly increases just at the moment When the load is lifted up from the underlay and becomes free hanging. This pressure increase is much more rapid than the pressure increases caused by the natural oscillations which are present in the steel structure of the crane, and hereby it will be possible for the detecting means 36 to separate "lifting up" and "oscillation". A lifting up of a load, i.e. the initiation of a new lifting cycle, may consequently be established when the velocity of the pressure increase on the piston side 8*a* the lifting cylinder 8 exceeds a given threshold value. A rapid pressure increase may however also be caused by the induced pressure on the piston side 8*a* of the lifting cylinder that may ensue during a lowering movement due to the fact that a certain pressure is required on the rod side 8*b* of the lifting cylinder in order to open the load holding valve 31. In order to avoid an erroneous detection of a new lifting cycle in connection with a pressure increase of the last-mentioned type, the detecting means 36 is adapted to detect the initiation of a new lifting cycle of the crane when the following conditions are simultaneously fulfilled:

- the measured velocity of a hydraulic pressure increase on the piston side 8*a* of the lifting cylinder exceeds the given threshold value, and
- it is detected that a lifting movement of the crane 1 is taking place.

The detecting means 36 may obtains information whether or not a lifting movement of the crane is taking place via the sensors 32 which register the movements of the slide members in the directional-control-valve sections 23. The detecting means 36 is connected to the processing unit 33, to which it transmits information concerning detected initiations of new lifting cycles. In FIG. 3 the detecting means 36 is shown as separate units, but it may with advantage be integrated in the processing unit 33.

According to the present invention, the crane 1 comprises means 38, e.g. integrated in the processing unit 33, for registration of a minimum value $V_{min}$ of each detected lifting cycle representing the lowest hydraulic pressure $p_1$ on the piston side 8*a* of the lifting cylinder during the lifting cycle or the lowest cylinder force $F_c$ of the lifting cylinder during the lifting cycle. The processing unit 33 is adapted to determine the present value of the capacity level of the crane taking into account, for at least the lifting cycles involving the operation of a hydraulic grab tool 12, a control value $V_c$ corresponding to:

- the minimum value $V_{min}$ registered for the previous lifting cycle, or
- the lowest one of the minimum value $V_{min}$ registered for the previous lifting cycle and the minimum value $V_{min}$ registered for the present lifting cycle.

According to a first embodiment of the invention, the processing unit 33 is adapted to calculate the present value of the capacity level of the crane by a formula having the control value $V_C$ as a variable parameter. In this case the following formula is preferably used:

$$L_{max}=p_{MAX}\cdot(1-(V_{MAX}-V_C)/p_{MAX})$$

where $L_{max}$ is the present value of the capacity level of the crane expressed in the maximum allowed hydraulic pressure on the piston side 8*a* of the lifting cylinder, $p_{MAX}$ is a preset upper value of the capacity level of the crane expressed in the maximum allowed hydraulic pressure on the piston side of the lifting cylinder, $V_C$ is the control value expressed in hydraulic pressure, and $V_{MAX}$ is a preset value of the hydraulic pressure on the piston side of the lifting cylinder corresponding to the lowest possible load on the crane when equipped for performing working operations of the above-indicated type A without any rotator between the boom and the hook. When using this formula, the minimum value $V_{min}$ is chosen to represent the lowest hydraulic pressure $p_1$ on the piston side 8*a* of the lifting cylinder, corresponding to the lowest force in the piston rod as calculated by the formula $F_c=p_1-p_2\cdot(D^2-d^2)/D^2$ indicated in the next paragraph below, during the respective lifting cycle. The above-indicated formula $L_{max}=p_{MAX}\cdot(1-(V_{MAX}-V_C)/p_{MAX})$ gives a present value of the capacity level of the crane for lifting cycles involving any of the above-indicated types A-G of working operations. The values $P_{MAX}$ and $V_{MAX}$ are constants. $p_{MAX}$ represents the maximum capacity level of the crane and is established for the respective crane type by means of stress calculations related to static strength as well as fatigue strength. $V_{max}$ may be established empirically.

The cylinder force $F_c$ of the lifting cylinder may be determined by measuring the force on the piston rod 8*c* or the cylinder 8*d* of the lifting cylinder, e.g. by means of strain gauges. Alternatively, the cylinder force $F_c$ of the lifting cylinder may be calculated by the following formula:

$$F_C=p_1-p_2\cdot(D^2-d^2)/D^2$$

where $p_1$ is the hydraulic pressure on the piston side of the lifting cylinder measured by the pressure sensor 34*a*, $p_2$ is the hydraulic pressure on the rod side of the lifting cylinder measured by the pressure sensor 34*b*, D is the diameter of the piston 8*e* of the lifting cylinder and d is the diameter of the piston rod 8*c* of the lifting cylinder.

According to an alternative embodiment of the invention, the processing unit 33 is adapted to identify, based on registrations of the crane functions that are being controlled via the control system of the crane, the working operation performed during the respective lifting cycle as being of a certain type among a number of predetermined types of working operations. The processing unit 33 is able to register the control of a specific crane function based on the information from the above-mentioned sensors 32. In this case, the processing unit 33 is adapted to take the identified type of working operation into account in the determination of the present value of the capacity level of the crane by selecting, among a number of stored preset values representing the capacity level of the crane for the predetermined types of working operations, the values applying for a type of working operation corresponding to the identified one. Furthermore, the processing unit 33 is for each ongoing lifting cycle that is identified as a type of working operation involving the operation of a hydraulic grab tool adapted to also take the above-mentioned control value $V_c$ into account in the determination of the present value of the capacity level of the crane.

The predetermined types of working operations may comprise:

- a first type of working operation embracing simple lifting operations, i.e. working operations of the above-indicated types A and B,
- a second type of working operations embracing lifting operations with the use of a jib, i.e. working operations of the above-indicated type C, and a third type of working operations embracing working operations involving the operation of a hydraulic grab tool, i.e. working operations of the above-indicated types D-G.

At least one preset value of the capacity level is established for each predetermined type of working operations that has been defined. Said values are preferably stored in a memory 35 included in the processing unit 33 and are established for the respective crane type by means of stress calculations related to static strength as well as fatigue strength.

According to a preferred embodiment of the invention, one preset capacity level value $L_{max,lifting}$ is established and stored for the above-indicated first type of working operations and one preset capacity level value $L_{max,jib}$ is established and stored for the above-indicated second type of working operations. For the above-indicated third type of working operations, i.e. working operations involving the operation of a hydraulic grab tool, several preset capacity level values are established and stored. The respective one of the last-mentioned preset capacity level values is associated with a specific type of grab tool and adapted to the stress range normally occurring during the operation of the grab tool type in question. The preset capacity level values for said third type of working operations may for instance include a first value $L_{max,brick/block}$ associated with grab tools in the form of brick and block clamps and dry wall clamps, a second value $L_{max,digging}$ associated with grab tools in the form of excavation buckets, and a third value $L_{max,scrap}$ associated with grab tools in the form of scrap tools. In this case said first, second and third values should have the following magnitude in relation to each other: $L_{max,brick/block}>L_{max,digging}>L_{max,scrap}$.

For the above-indicated third type of working operations, i.e. working operations involving the operation of a hydraulic grab tool, threshold values $V_{th}$ to be used for evaluating the above-mentioned control value $V_C$ are also established and stored. Said threshold values should be one less than the number of preset capacity level values established for the above-indicated third type of working operations. In a case where the preset capacity level values include the above indicated values $L_{max,brick/block}$, $L_{max,digging}$ and $L_{max,scrap}$, a first threshold value $V_{th,brick/block}$ and a second threshold value $V_{th,digging}$ should consequently be established. In this case said first and second threshold values should have the following magnitude in relation to each other: $V_{th,brick/block}>V_{th,digging}$.

The above-indicated preset capacity level values $L_{max,lifting}$, $L_{max,jib}$, $L_{max,brick/block}$, $L_{max,digging}$, $L_{max,scrap}$ and threshold values $V_{th,brick/block}$, $V_{th,digging}$ are used in the following manner in the establishment of the present value of the capacity level of a crane:

If the working operation performed during a lifting cycle is identified as being of the above-indicated first type of working operation, i.e. if no control of a jib function or tool function is detected, the processing unit 33 is adapted to set the present value of the capacity level to $L_{max,lifting}$.

If the working operation performed during a lifting cycle is identified as being of the above-indicated second type of working operation, i.e. if the control of a jib function is detected during the lifting cycle, the processing unit 33 is adapted to set the present value of the capacity level to $L_{max,jib}$.

If the working operation performed during a lifting cycle is identified as being of the above-indicated third type of working operation, i.e. if the control of a tool function (grab function) is detected during the lifting cycle, the processing unit 33 is adapted to compare the control value $V_C$ with the threshold values $V_{th,brick/block}$, $V_{th,digging}$. The processing unit 33 is adapted to set the present value of the capacity level to:

$L_{max,brick/block}$, if the comparison shows that $V_C>V_{th,brick/block}$, $L_{max,digging}$, if the comparison shows that $V_{th,brick/block}>V_C>V_{th,digging}$, $L_{max,scrap}$, if the comparison shows that $V_C<V_{th,digging}$.

If the crane is equipped with a winch, a fourth type of working operations embracing lifting operations with the use of winch could also be defined. In this case, a preset capacity level value $L_{max,winch}$ should also be established and stored for this fourth type of working operations. If the working operation performed during a lifting cycle is identified as being of this fourth type of working operation, i.e. if the control of a winch function is detected during the lifting cycle, the processing unit 33 is adapted to set the present value of the capacity level to $L_{max,winch}$.

For the first lifting cycle after a start up of the crane, the control value $V_c$ may for instance be set to correspond to the latest registered control value before the start up.

Figure 4:
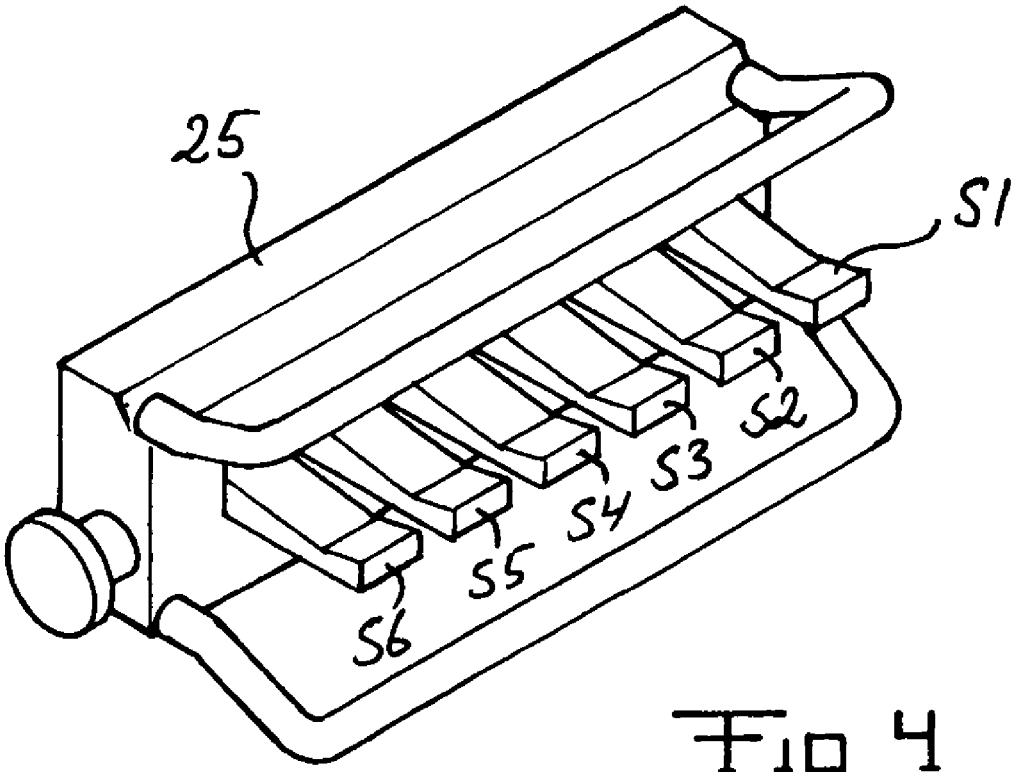
FIG. 4 a perspective view of a control unit with a number of control devices for control of different crane functions.

The order between the control members for controlling the different functions of a lorry crane has been standardised for many years. FIG. 4 schematically shows an example of a conventionally designed control unit 25 with six control levers S1-S6 for controlling six different crane functions. A lorry crane which is not provided with any winch normally has such a control unit provided with six control levers. In case the crane has a winch, the control unit normally is provided with seven or nine control levers.

Lever S1, i.e. the right lever in the figure, controls the rotation of the column 4. The lever S2 controls the lifting function, i.e. the hydraulic flow to the lifting cylinder 8. The lever S3 controls the tilting function, i.e. the hydraulic flow to the outer boom cylinder 9. The lever S4 controls extension and retraction, i.e. the hydraulic flow to the extension boom cylinder 10. The levers S5 and S6 control different crane functions depending on how the crane is equipped. When a rotator 11 is attached to the extension boom 7, the lever S5 controls the rotation of the rotator 11, i.e. the hydraulic flow to the force member of the rotator. However, if a jib 15 is attached to the extension boom 7, the lever S5 is adapted to control the tilting of the jib boom 16, i.e. the hydraulic flow to the jib boom cylinder 17. If a hydraulic grab tool 12 is attached to the rotator 11, the lever S6 controls the grab function of the grab tool, i.e. the hydraulic flow to the grab cylinder 17. If however a jib 15 is attached to the extension boom 7, the lever S6 controls the extension function of the jib, i.e. the hydraulic flow to the extension boom cylinder 18 of the jib. It is realised that also other orders of the control levers for the different crane functions are possible and that also other crane functions than the ones here described may be arranged to be controlled by the control levers.

In the example above, the levers S5 and S6 are adapted to control different crane functions depending on how the crane is equipped. For the processing unit to be able to decide which type of crane function that is controlled when any of these levers is manipulated, the crane has to comprise means for detecting the type of crane element that is mounted to the extension boom 7. Such a means is included in an overload protection device developed by HIAB AB and available on the market. This overload protection device comprises means for detecting whether or not the sensors (pressure sensor and inclinometer) of the jib are connected. When the overload protection device identifies that these sensors are connected, the manipulation of any of the levers S5 and S6 is interpreted as a control of a jib function (tilting and extension, respectively) and the overload protection device applies the logic relating to working operations including use of a jib. If the jib is temporarily demounted, for instance when the crane is to be used with a hydraulic grab tool instead of a jib, a specially constructed plug has to be placed in the electric line to the jib. When the overload protection device identifies that this plug has been put in place, the manipulation of any of the levers S5 and S6 is interpreted as a control of rotator and grab tool, respectively.

The inventive solution implies that the capacity level, i.e. the maximum allowed lifting force, is automatically adjusted depending on how the crane is operated, whereby it will be possible to regulate the capacity level in such a way that the crane can be used efficiently during all types of working operations without jeopardizing the fatigue strength.

The invention is of course not in any way restricted to the preferred embodiments described above. On the contrary, many possibilities to modifications thereof will be apparent to a person with ordinary skill in the art without departing from the basic idea of the invention such as defined in the appended claims.

The invention claimed is:

1. A method for determining a present value ($L_{max}$) of the capacity level of a hydraulic crane (1) provided with a lifting cylinder (8) and a processing unit (33), comprising the steps of detecting initiation of each new lifting cycle of the crane, registering a minimum value ($V_{min}$) of each lifting cycle, which represents lowest hydraulic pressure ($p_1$) on a piston side (8*a*) of the lifting cylinder or cylinder force ($F_c$) of the lifting cylinder during the lifting cycle, determining with the processing unit (33) for at least some lifting cycles, the present value ($L_{max}$) of the capacity level of the crane by taking into account a control value ($V_c$) corresponding to:

a minimum value ($V_{min}$) registered for a previous lifting cycle, or lowest of the minimum value ($V_{min}$) registered for the previous lifting cycle and minimum value ($V_{min}$) registered for the present lifting cycle.

2. A method according to claim 1, comprising the steps of measuring hydraulic pressure ($p_1$) on the piston side (8*a*) of the lifting cylinder and ($p_2$) on a rod side (8*b*) of the lifting cylinder during each lifting cycle, and using the thus-measured hydraulic pressure ($p_1$) on the piston side of the lifting cylinder and ($p_2$) on the rod side of the lifting cylinder to calculate cylinder force ($F_c$) of the lifting cylinder.

3. A method according to claim 1, comprising the step of determining cylinder force ($F_c$) of the lifting cylinder by measuring force on a piston rod (8*c*) or the cylinder (8*d*) of the lifting cylinder.

4. A method according to claim 1, comprising the step of calculating the present value of the capacity level ($L_{max}$) of the crane with a formula including the control value ($V_c$) as a variable parameter.

5. A method according to claim 4, wherein the minimum value ($V_{min}$) represents lowest cylinder force ($F_c$) of the lifting cylinder during a respective lifting cycle, and comprising the step of calculating the present value ($L_{max}$) of the capacity level of the crane with the following formula:

$$L_{max}=p_{max}\cdot(1-(V_{max}-V_c)/p_{max})$$

where $L_{max}$ is the present value of the capacity level of the crane expressed as maximum allowed hydraulic pressure on the piston side (8*a*) of the lifting cylinder, $p_{max}$ is a preset upper value of the capacity level of the crane expressed as maximum allowed hydraulic pressure on the piston side of the lifting cylinder, $V_c$ is the control value expressed as hydraulic pressure, and $V_{max}$ is a preset value of hydraulic pressure on the piston side of the lifting cylinder corresponding to lowest possible load on the crane when equipped for performing working operations using a lifting hook and without any jib boom or rotator attached to the crane.

6. A method according to claim 1, comprising the step of measuring velocity of hydraulic pressure increases on the piston side (8*a*) of the lifting cylinder and detecting initiation of a new lifting cycle of the crane when the following conditions are simultaneously fulfilled:

the measured velocity of a hydraulic pressure increase on the piston side (8*a*) of the lifting cylinder exceeds a given threshold value, and detecting a lifting movement of the crane (1) is taking place.

7. A method for determining a present value ($L_{max}$) of the capacity level of a hydraulic crane (1) provided with a lifting cylinder (8) and a processing unit (33), comprising the steps of detecting initiation of each new lifting cycle of the crane, registering a minimum value ($V_{min}$) of each lifting cycle, which represents lowest hydraulic pressure ($p_1$) on a piston side (8*a*) of the lifting cylinder or cylinder force ($F_c$) of the lifting cylinder during the lifting cycle, determining with the processing unit (33) for at least some of the lifting cycles, the present value ($L_{max}$) of the capacity level of the crane by taking into account a control value ($V_c$) corresponding to:

a minimum value ($V_{min}$) registered for a previous lifting cycle, or lowest of the minimum value ($V_{min}$) registered for the previous lifting cycle and minimum value ($V_{min}$) registered for the present lifting cycle, wherein the crane (1) comprises a system for controlling different crane functions for performance of different types of working operations and means (32, 33) for registering crane functions being controlled via the control system during the respective lifting cycle, and comprising the additional steps of the processing unit (33) identifying, based on registering of crane functions being controlled, working operation performed during the respective lifting cycle of a certain type among a number of predetermined types of working operations, the processing unit (33) taking the identified type of working operation into account in the present value ($L_{max}$) of the capacity level of the crane by selecting, among a number of stored preset values ($L_{max,lifting}$, $L_{max,jib}$, $L_{max,brick/block}$, $L_{max,digging}$, $L_{max,scrap}$) representing the capacity level of the crane for the predetermined types of working operations the values applying for a type of working operation corresponding to the identified one, and the processing unit (33), for each lifting cycle where the performed working operation is identified as an operation involving a hydraulic grab tool (12) attached to the crane, also taking the control value ($V_c$) into account in determining the present value ($L_{max}$) of the capacity level of the crane.

8. A method according to claim 7, comprising the step of the processing unit (33), for each lifting cycle where the performed working operation is identified as a working operation involving the operation of a hydraulic grab tool (12), comparing the control value ($V_c$) with a number of threshold values ($V_{th,brick/bloc}$, $V_{th,digging}$), and determining the present value ($L_{max}$) of the capacity level of the crane depending upon result of said comparing.

9. A hydraulic crane comprising a lifting cylinder (8), a processing unit (33) for determining a present value ($L_{max}$) of the capacity level of the crane (1), means (36) for detecting initiation of a new lifting cycle of the crane, means (38) for registering a minimum value ($V_{min}$) of each lifting cycle representing lowest hydraulic pressure ($p_1$) on a piston side (8*a*) of the lifting cylinder or cylinder force ($F_c$) of the lifting cylinder during the lifting cycle, and the processing unit (33) is structured and arranged to determine the present value ($L_{max}$) of the capacity level of the crane taking into account, for at least some lifting cycles, a control value ($V_c$) corresponding to:

a minimum value ($V_{min}$) registered for a previous lifting cycle, or lowest of the minimum value ($V_{min}$) registered for the previous lifting cycle and minimum value ($V_{min}$) registered for the present lifting cycle.

10. A hydraulic crane according to claim 9, additionally comprising means (34*a*) for measuring hydraulic pressure ($p_1$) on the piston side (8*a*) of the lifting cylinder, means (34*b*) for measuring hydraulic pressure ($p_2$) on a rod side (8*b*) of the lifting cylinder, and the processing unit (33) is structured and arranged to use the measured hydraulic pressure ($p_1$) on the piston side of the lifting cylinder and ($p_2$) on the rod side of the lifting cylinder for calculating cylinder force ($F_c$) of the lifting cylinder.

11. A hydraulic crane according to claim 10, wherein the processing unit (33) is structured and arranged to calculate the present value ($L_{max}$) of the capacity level of the crane by a formula having the control value ($V_c$) as a variable parameter.

12. A hydraulic crane according to claim 11, wherein the minimum value ($V_{min}$) represents lowest cylinder force ($F_c$) of the lifting cylinder during a respective lifting cycle, and the processing unit (33) is structured and arranged to calculate the present value ($L_{max}$) of the capacity level of the crane with the following formula:

$$L_{max}=p_{max}\cdot(1-(V_{max}-V_c)/p_{max})$$

where $L_{max}$ the present value of the capacity level of the crane expressed as maximum allowed hydraulic pressure on the piston side (8*a*) of the lifting cylinder, $p_{max}$ is a preset upper value of the capacity level of the crane expressed as maximum allowed hydraulic pressure on the piston side of the lifting cylinder, $V_c$ is the control value expressed as hydraulic pressure, and $V_{max}$ is a preset value of the hydraulic pressure on the piston side of the lifting cylinder corresponding to lowest possible load on the crane when equipped for performing working operations using a lifting hook and without any jib boom or rotator attached to the crane.

13. A crane according to claim 10, additionally comprising a control system for controlling different crane functions for performance of different types of working operations, and means (32, 33) for registering crane functions controlled via the control system during a respective lifting cycle, the processing unit (33) is structured and arranged to identify, based on registering of the crane functions being controlled, working operation performed during the respective lifting cycle of a certain type among a number of predetermined types of working operations, take the identified type of working operation into account in determining the present value ($L_{max}$) of the capacity level of the crane by selecting, among a number of stored preset values ($L_{max,lifting}$, $L_{max,jib}$, $L_{max,brick/block}$, $L_{max,digging}$, $L_{max,scrap}$) representing capacity level of the crane for the predetermined types of working operations, the values applying for a type of working operation corresponding to the identified one, and for each lifting cycle where the performed working operation is identified as a type of working operation involving operation of a hydraulic grab tool (12) attached to the crane, also take the control value ($V_c$) into account in determining the present value ($L_{max}$) of the capacity level of the crane.

14. A crane according to claim 13, wherein the processing unit (33), for each lifting cycle where the performed working operation is identified as a working operation involving the operation of a hydraulic grab tool (12), is structured and arranged to compare the control value ($V_c$) with a number of threshold values ($V_{th,brick/block}$, $V_{th,digging}$), and determine the present value ($L_{max}$) of the capacity level of the crane depending upon result of said comparing.

15. A crane according to claim 10, additionally comprising means (34*a*) for measuring velocity of hydraulic pressure increases on the piston side (8*a*) of the lifting cylinder, and means for detecting lifting movements of the crane, and the lifting cycle detecting means (36) is structured and arranged to detect initiation of a new lifting cycle of the crane when the following conditions are simultaneously fulfilled:

the measured velocity of a hydraulic pressure increase on the piston side (8*a*) of the lifting cylinder exceeds a given threshold value, and detecting a lifting movement of the crane (1) is taking place.

16. A hydraulic crane according to claim 9, wherein the processing unit (33) is structured and arranged to calculate the present value ($L_{max}$) of the capacity level of the crane by a formula having the control value ($V_c$) as a variable parameter.

17. A hydraulic crane according to claim 16, wherein the minimum value ($V_{min}$) represents lowest cylinder force ($F_c$) of the lifting cylinder during a respective lifting cycle, and the processing unit (33) is structured and arranged to calculate the present value ($L_{max}$) of the capacity level of the crane with the following formula:

$$L_{max}=p_{max}\cdot(1-(V_{max}-V_c)/p_{max})$$

where $L_{max}$ the present value of the capacity level of the crane expressed as maximum allowed hydraulic pressure on the piston side (8*a*) of the lifting cylinder, $p_{max}$ is a preset upper value of the capacity level of the crane expressed as maximum allowed hydraulic pressure on the piston side of the lifting cylinder, $V_c$ is the control value expressed as hydraulic pressure, and $V_{max}$ is a preset value of the hydraulic pressure on the piston side of the lifting cylinder corresponding to lowest possible load on the crane when equipped for performing working operations using a lifting hook and without any jib boom or rotator attached to the crane.

18. A crane according to claim 9, additionally comprising means (34*a*) for measuring velocity of hydraulic pressure increases on the piston side (8*a*) of the lifting cylinder, and means for detecting lifting movements of the crane, and the lifting cycle detecting means (36) is structured and arranged to detect initiation of a new lifting cycle of the crane when the following conditions are simultaneously fulfilled:

the measured velocity of a hydraulic pressure increase on the piston side (8*a*) of the lifting cylinder exceeds a given threshold value, and detecting a lifting movement of the crane (1) is taking place.

19. A crane comprising a lifting cylinder (8), a processing unit (33) for determining a present value ($L_{max}$) of the capacity level of the crane (1), means (36) for detecting initiation of a new lifting cycle of the crane, means (38) for registering a minimum value ($V_{min}$) of each lifting cycle representing lowest hydraulic pressure ($p_1$) on a piston side (8*a*) of the lifting cylinder or cylinder force ($F_c$) of the lifting cylinder during the lifting cycle, and the processing unit (33) is structured and arranged to determine the present value ($L_{max}$) of the capacity level of the crane taking into account, for at least some lifting cycles, a control value ($V_c$) corresponding to:

a minimum value ($V_{min}$) registered for a previous lifting cycle, or lowest of the minimum value ($V_{min}$) registered for the previous lifting cycle and minimum value ($V_{min}$) registered for the present lifting cycle, additionally comprising a control system for controlling different crane functions for performance of different types of working operations, and means (32, 33) for registering crane functions controlled via the control system during a respective lifting cycle, the processing unit (33) is structured and arranged to identify, based on registering of the crane functions being controlled, working operation performed during the respective lifting cycle of a certain type among a number of predetermined types of working operations, take the identified type of working operation into account in determining the present value ($L_{max}$) of the capacity level of the crane by selecting, among a number of stored preset values ($L_{max,lifting}$, $L_{max,jib}$, $L_{max,brick/block}$, $L_{max,digging}$, $L_{max,scrap}$) representing capacity level of the crane for the predetermined types of working operations, the values applying for a type of working operation corresponding to the identified one, and for each lifting cycle where the performed working operation is identified as a type of working operation involving operation of a hydraulic grab tool (12) attached to the crane, also take the control value ($V_c$) into account in determining the present value ($L_{max}$) of the capacity level of the crane.

20. A crane according to claim 19, wherein the processing unit (33), for each lifting cycle where the performed working operation is identified as a working operation involving the operation of a hydraulic grab tool (12), is structured and arranged to compare the control value ($V_c$) with a number of threshold values ($V_{th,brick/block}$, $V_{th,digging}$), and determine the present value ($L_{max}$) of the capacity level of the crane depending upon result of said comparing.

* * * * *